US012605023B2

(12) United States Patent
Choi et al.

(10) Patent No.: US 12,605,023 B2
(45) Date of Patent: Apr. 21, 2026

(54) CLEANING DEVICE HAVING CLEANER AND DOCKING STATION

(71) Applicant: Samsung Electronics Co., Ltd., Suwon-si (KR)

(72) Inventors: Ingyu Choi, Suwon-si (KR); Hyunju Lee, Suwon-si (KR); Seehyun Kim, Suwon-si (KR); Seungryong Cha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 369 days.

(21) Appl. No.: 18/340,315

(22) Filed: Jun. 23, 2023

(65) Prior Publication Data

US 2023/0346183 A1 Nov. 2, 2023

Related U.S. Application Data

(63) Continuation of application No. PCT/KR2022/000511, filed on Jan. 12, 2022.

(30) Foreign Application Priority Data

Mar. 10, 2021 (KR) ..... 10-2021-0031611

(51) Int. Cl.
*A47L 9/14* (2006.01)
*A47L 9/28* (2006.01)

(52) U.S. Cl.
CPC ..... *A47L 9/149* (2013.01); *A47L 9/1409* (2013.01); *A47L 9/2873* (2013.01)

(58) Field of Classification Search
CPC ..... A47L 9/149; A47L 9/1409; A47L 9/2873
See application file for complete search history.

(56) References Cited

U.S. PATENT DOCUMENTS 6,886,215 B2 * 5/2005 Dodson ..... A47L 9/1436 15/350
10,464,746 B2 * 11/2019 Conrad ..... B65F 1/105
11,134,818 B2 10/2021 Kim et al.
(Continued)

FOREIGN PATENT DOCUMENTS

JP 2017-189453 A 10/2017
JP 2019-005069 A 1/2019
(Continued)

OTHER PUBLICATIONS

International Search Report dated May 9, 2022, issued in International Patent Application No. PCT/KR2022/000511.

*Primary Examiner* — Marc Carlson
(74) *Attorney, Agent, or Firm* — Jefferson IP Law, LLP

(57) ABSTRACT

A docking station, which includes a cover opening and closing device for automatically opening and closing a dust container cover, and a cleaning device is provided. The cleaning device includes a cleaner which includes a dust container for collecting foreign substances, a dust container cover rotatably coupled to the dust container so as to open and close the dust container, and a button provided to open the dust container, a docking station to which the cleaner is coupled, and which charges the cleaner coupled thereto, and a cover opening and closing device which opens the dust container cover by pressing the button and closes the dust container cover by pressing the dust container cover.

13 Claims, 14 Drawing Sheets

(56) References Cited

U.S. PATENT DOCUMENTS

| | | | | |
|---|---|---|---|---|
| 11,272,820 | B2 * | 3/2022 | Sato | A47L 9/242 |
| 2015/0223657 | A1 * | 8/2015 | Choe | A47L 9/1641 55/392 |
| 2020/0138255 | A1 * | 5/2020 | Sato | A47L 9/0063 |
| 2021/0259490 | A1 * | 8/2021 | Kim | A47L 9/2894 |
| 2021/0290017 | A1 | 9/2021 | Kim et al. | |
| 2023/0060474 | A1 * | 3/2023 | Kim | A47L 9/0063 |
| 2023/0083922 | A1 | 3/2023 | Kim et al. | |
| 2023/0084505 | A1 | 3/2023 | Kim et al. | |
| 2023/0146588 | A1 * | 5/2023 | Kim | A47L 9/106 15/347 |

FOREIGN PATENT DOCUMENTS

| | | | |
|---|---|---|---|
| JP | 6648618 | B2 | 2/2020 |
| JP | 7117085 | B2 | 8/2022 |
| KR | 10-2020-0074055 | A | 6/2020 |
| KR | 10-2165474 | B1 | 10/2020 |
| KR | 10-2166773 | B1 | 10/2020 |
| KR | 10-2020-0131208 | A | 11/2020 |
| KR | 10-2180680 | B1 | 11/2020 |
| KR | 10-2021-0002057 | A | 1/2021 |
| KR | 10-2021-0019940 | A | 2/2021 |
| KR | 10-2022-0119617 | A | 8/2022 |
| WO | 2021-177572 | A1 | 9/2021 |

* cited by examiner

CLEANING DEVICE HAVING CLEANER AND DOCKING STATION

CROSS-REFERENCE TO RELATED APPLICATION(S)

This application is a continuation application, claiming priority under § 365(c), of an International application No. PCT/KR2022/000511, filed on Jan. 12, 2022, which is based on and claims the benefit of a Korean patent application number 10-2021-0031611, filed on Mar. 10, 2021, in the Korean Intellectual Property Office, the disclosure of which is incorporated by reference herein in its entirety.

BACKGROUND

1. Field

The disclosure relates to a cleaning device including a cleaner and a docking station. More particularly, the disclosure relates to a cleaning device and a docking station including a cover opening and closing device for automatically opening and closing a dust container cover of a cleaner.

2. Description of Related Art

In general, a vacuum cleaner is an appliance that includes a fan motor for generating a suction force and performs cleaning by sucking foreign substances, such as dust, or the like, together with air through a suction force generated by the fan motor, separating the foreign substances included in the sucked air from the air and then collecting the foreign substances.

The vacuum cleaner includes a dust container for collecting foreign substances, and a user needs to discharge foreign substances collected in the dust container periodically from the dust container by detaching the dust container from the vacuum cleaner.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cleaning device and a docking station including a cover opening and closing device for automatically opening and closing a dust container cover of a cleaner.

Additional aspects will be set forth in part in the description which follows and, in part, will be apparent from the description, or may be learned by practice of the presented embodiments.

In accordance with an aspect of the disclosure, a cleaning device is provided. The cleaning device includes a cleaner including a dust container in which foreign substances are collected, a dust container cover rotatably coupled to the dust container and configured to open and close the dust container, and a button configured to open the dust container cover, a docking station to which the cleaner is coupled, the docking station configured to charge the cleaner coupled thereto, and a cover opening and closing device configured to open the dust container cover by pressing the button and close the dust container cover by pressing the dust container cover.

The cover opening and closing device includes a driving motor configured to provide a driving force, and a guide configured to press the button or the dust container cover by receiving a driving force from the driving motor.

The driving motor includes a driving shaft configured to rotate in a first direction or a second direction that is opposite to the first direction by the driving force.

The guide includes a first guide configured to rotate in the first direction or the second direction together with the driving shaft, and a second guide configured to perform a translational movement according to a rotation of the first guide.

The guide further includes a rotating guide configured to rotate in the first direction or the second direction according to a translational movement of the second guide.

The rotating guide may press the button by rotating in the second direction.

The cover opening and closing device further includes a push lever configured to press the button by rotating in the first direction and a third direction that is different from the second direction, according to a rotation in second direction of the rotating guide.

A rotating shaft of the push lever may intersect with a rotating shaft of the rotating guide.

The cover opening and closing device further includes a closing guide configured to press the dust container cover by rotating in the first direction together with the rotating guide, according to a rotation in first direction of the rotating guide.

The docking station further includes a duct configured to guide foreign substances collected in the dust container to a dust bag.

The closing guide may be positioned inside the duct.

The driving motor, the first guide, the second guide, the rotating guide, and the push lever may be positioned outside the duct.

The rotating guide further includes a first limiting protrusion configured to limit a rotation range of the rotating guide in the first direction, and a second limiting protrusion configured to limit a rotation range of the rotating guide in the second direction.

The docking station further includes a stopper configured to limit movement ranges of the first limiting protrusion and the second limiting protrusion.

One end of the stopper may contact the first limiting protrusion according to a rotation in first direction of the rotating guide.

Another end of the stopper may contact the second limiting protrusion according to a rotation in second direction of the rotating guide.

The cover opening and closing device further includes a switch configured to be pressed by the first limiting protrusion according to a rotation in first direction of the rotating guide.

According to pressing of the switch, the driving motor may stop and a reference position of the driving shaft may be reset.

The cleaner further includes an elastic member configured to elastically bias the dust container cover such that the dust container cover rotates in a direction of being closed.

In accordance with another aspect of the disclosure, a cleaning device is provided. The cleaning device includes a cleaner including a dust container in which foreign substances are collected, and a dust container cover rotatably coupled to the dust container and configured to open and close the dust container, and a button configured to open the dust container cover, and a docking station to which the cleaner is coupled, the docking station configured to charge the cleaner coupled thereto, wherein the docking station includes a driving motor configured to rotate a driving shaft, a first guide configured to rotate together with the driving shaft, a second guide configured to move up and down according to a rotation of the first guide, a rotating guide configured to rotate according to a movement of the second guide and configured to open the dust container cover by rotating, and a closing guide configured to rotate together with the rotating guide and close the dust container cover by rotating.

The cleaner further includes a button configured to open the dust container cover by being pressed.

The docking station further includes a push lever configured to rotate together with the rotating guide and press the button by rotating.

A rotating shaft of the push lever may intersect with a rotating shaft of the rotating guide.

The docking station further includes a duct configured to guide foreign substances collected in the dust container to a dust bag.

The closing guide may be positioned inside the duct.

The driving motor, the first guide, the second guide, and the rotating guide may be positioned outside the duct.

The cleaner further includes an elastic member configured to elastically bias the dust container cover such that the dust container cover rotates in a direction of being closed.

According to a concept of the disclosure, there are provided a cleaning device and a docking station including a cover opening and closing device for automatically opening and closing a dust container cover of a cleaner.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
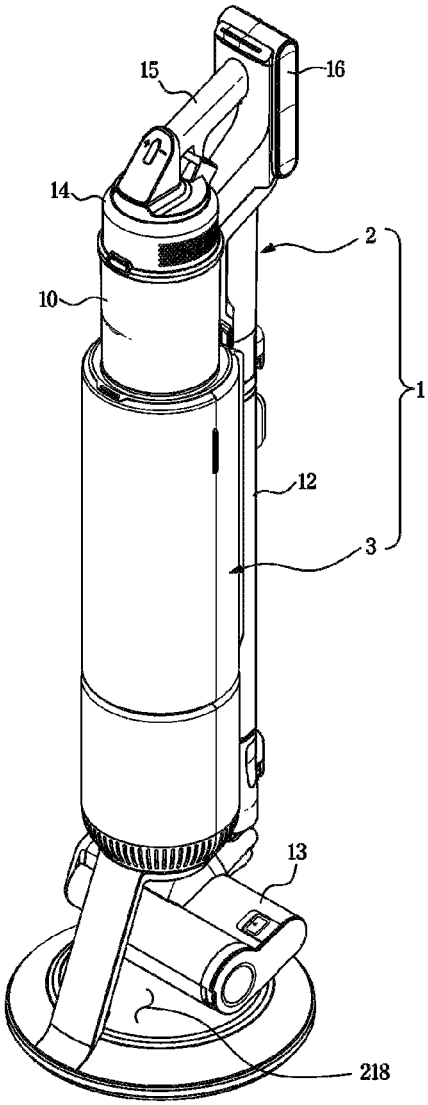
FIG. 1 illustrates a state in which a cleaner is coupled to a docking station in a cleaning device according to an embodiment of the disclosure.

The following description with reference to the accompanying drawings is provided to assist in a comprehensive understanding of various embodiments of the disclosure as defined by the claims and their equivalent. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The singular forms "a," "an," and "the" used in the following description include plural referents unless the context clearly dictates otherwise. In the drawings, for easy understanding, the shapes or sizes of components are more or less exaggeratedly shown.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

The terms, such as "first", "second", or the like, are used only to distinguish one component from another, and these components should not be limited by these terms.

The singular forms "a," "an," and "the" include plural referents unless the context clearly dictates otherwise.

Hereinafter, the preferred embodiments of the disclosure will be described with reference to the accompanying drawings.

Figure 2:
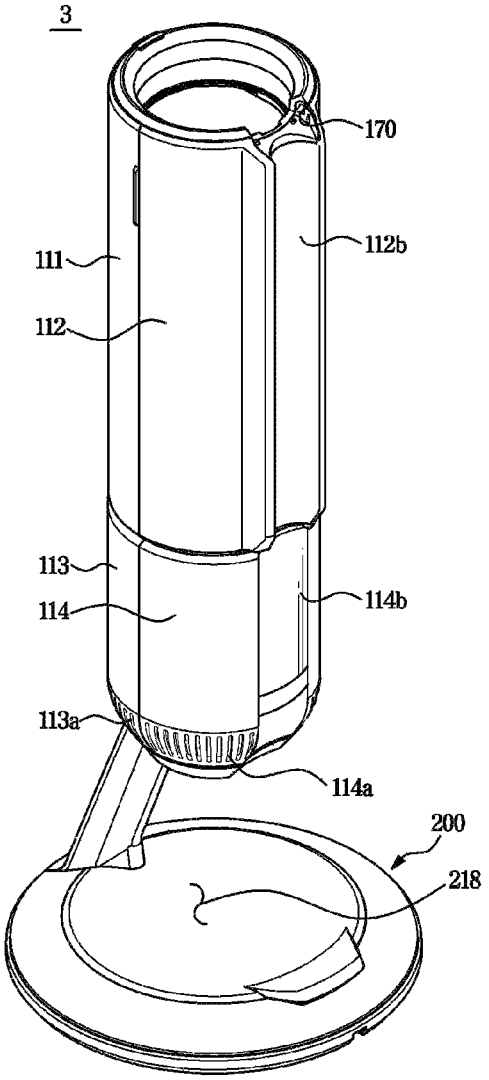
FIG. 2 illustrates a docking station of a cleaning device according to an embodiment of the disclosure.
Figure 3:
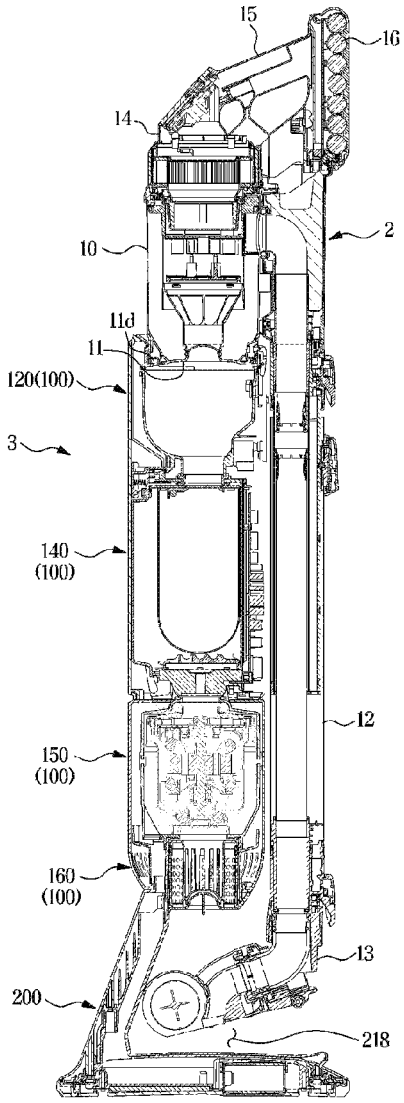
FIG. 3 illustrates a side cross-sectional view of a cleaning device according to an embodiment of the disclosure.

FIG. 1 illustrates a state in which a cleaner is coupled to a docking station in a cleaning device according to an embodiment of the disclosure. FIG. 2 illustrates a docking station of a cleaning device according to an embodiment of the disclosure. FIG. 3 illustrates a side cross-sectional view of a cleaning device according to an embodiment of the disclosure.

Referring to FIG. 1, a cleaning device 1 may include a cleaner 2, and a docking station 3 on which the cleaner 2 is rested. The cleaner 2 may be coupled to the docking station 3 by being rested on the docking station 3.

The cleaner 2 may include a cleaner body 14, and a dust container 10 detachably coupled to the cleaner body 14. The dust container 10 may collect foreign substances moved to inside of the cleaner 2.

The cleaner body 14 may include a suction motor (not shown) for generating a suction force required to suck foreign substances on a surface to be cleaned, and the dust container 10 in which the foreign substances sucked from the surface to be cleaned are stored.

The dust container 10 may filter dust, rubbish, or the like, from air entered the dust container 10 through a suction nozzle 13 and store the dust, rubbish, or the like. The dust container 10 may be detachable from the cleaner body 14.

The cleaner body 14 may include a filter housing. The filter housing may be substantially in a shape of a donut to accommodate a filter (not shown) therein. A kind of the filter is not limited, and for example, a Hepa filter may be positioned inside the filter housing. The filter may filter ultrafine dust that is not filtered in the dust container 10.

The cleaner body 14 may include a handle 15 that is gripped by a user to control the cleaner 2. The user may perform cleaning while moving the cleaner 2 by gripping the handle 15.

The cleaner body 14 may further include a controller. The user may control a power button provided in the controller to turn on/off the cleaner 2 or adjust a suction strength, or the like.

The cleaner 2 may further include an extension pipe 12 detachably coupled to the cleaner body 14, and a suction nozzle 13 detachably coupled to the extension pipe 12.

The suction nozzle 13 may suck external foreign substances to inside of the cleaner 2. The extension pipe 12 may connect the cleaner body 14 to the suction nozzle 13 to form a path along which foreign substances move. The sucked foreign substances may move to the dust container 10 via the cleaner body 14 and be collected in the dust container 10. For example, the extension pipe 12 may connect the suction nozzle 13 to the dust container 10. In the cleaner 2 according to an embodiment of the disclosure, the cleaner body 14 may be installed in the extension pipe 12 in a front direction of the extension pipe 12. The front direction may be defined as a front direction from a user who grips the cleaner 2.

The cleaner 2 may further include a battery 16. The battery 16 may be detachably installed in the cleaner 2.

In addition, the battery 16 may be electrically connected to a charging terminal 170 provided in a cleaner stand or the docking station 3. The battery 16 may be charged by receiving power from the charging terminal 170 provided in the docking station 3.

The docking station 3 may be configured to keep or place the cleaner 2 thereon.

The docking station 3 may include a body 100, and a supporter 200 supporting the body 100.

The body 100 may include a housing 111, 112, 113, and 114.

The body 100 may include a duct portion 120, a collecting portion 140, a suction portion 150, and an exhaust filter portion 160, which are accommodated inside the housing 111, 112, 113, and 114.

Upon coupling of the cleaner 2 to the docking station 3, the suction nozzle 13 may be accommodated in an accommodating space 218 formed in the docking station 3.

A first housing 111 and a second housing 112 may form an upper appearance of the docking station 3. The first housing 111 may be coupled to the second housing 112 to form the upper appearance of the docking station 3. The duct portion 120 and the collecting portion 140 may be accommodated inside the first housing 111 and the second housing 112. A dust bag in which dust collected in the dust container 10 is stored may be detachably installed in the collecting portion 140. Dust in the dust container 10 may be collected in the dust bag by passing through the duct portion 120.

The first housing 111 and the second housing 112 may have major axes extending in one direction. The major axes of the first housing 111 and the second housing 112 may extend in an up-down direction. Each of the first housing 111 and the second housing 112 may have a curved surface. The first housing 111 may be coupled to the second housing 112 to form a substantially cylindrical shape.

A third housing 113 and a fourth housing 114 may form a lower appearance of the docking station 3. The third housing 113 may be coupled to the fourth housing 114 to form the lower appearance of the docking station 3. The third housing 113 may be coupled to a lower portion of the first housing 111, and the fourth housing 114 may be coupled to a lower portion of the second housing 112. The suction portion 150 and the exhaust filter portion 160 may be accommodated inside the third housing 113 and the fourth housing 114.

The third housing 113 and the fourth housing 114 may have major axes extending in one direction. The major axes of the third housing 113 and the fourth housing 114 may extend in the up-down direction. The third housing 113 may correspond to a shape of the first housing 111, and the fourth housing 114 may correspond to a shape of the second housing 112. The third housing 113 may be coupled to the fourth housing 114 to form a substantially cylindrical shape.

According to an embodiment of the disclosure, the major axis of the third housing 113 may be shorter than the major axis of the first housing 111, and the major axis of the fourth housing 114 may be shorter than the major axis of the second housing 112, although not limited thereto. However, the major axes of the third housing and the fourth housing may be equal to or longer than the major axes of the first housing and the second housing.

According to an embodiment of the disclosure, the docking station 3 may include a depressed portion **112*b* and 114*b*. The depressed portion 112*b* and 114*b* may include a first depressed portion 112*b* and a second depressed portion 114*b***.

The first depressed portion **112*b* may be formed in the second housing 112. The first depressed portion 112*b* may be provided by depressing a portion of the second housing 112** inward. The first depressed portion 112*b* may extend along the major axis of the second housing 112. A portion of the extension pipe 12 of the cleaner 2 may be accommodated in the first depressed portion 112*b*.

The second depressed portion 114*b* may be formed in the fourth housing 114. The second depressed portion 114*b* may be provided by depressing a portion of the fourth housing 114 inward. The second depressed portion 114*b* may extend along the major axis of the fourth housing 114. A portion of the extension pipe 12 of the cleaner 2 may be accommodated in the second depressed portion 114*b*.

According to an arrangement in up-down direction of the second housing 112 and the fourth housing 114, the first depressed portion 112*b* may be connected to the second depressed portion 114*b* in the up-down direction. An upper portion of the extension pipe 12 of the cleaner 2 may be accommodated in the first depressed portion 112*b*, and a lower portion of the extension pipe 12 of the cleaner 2 may be accommodated in the second depressed portion 114*b*.

The third housing 113 may include a first exhaust hole 113*a*. The fourth housing 114 may include a second exhaust hole 114*a*. The third housing 113 and the fourth housing 114 may need to discharge sucked air to outside because the third housing 113 and the fourth housing 114 accommodate the suction portion 150 therein. Because the third housing 113 and the fourth housing 114 include the first exhaust hole 113*a* and the second exhaust hole 114*a*, air sucked through the suction portion 150 may be discharged to outside of the third housing 113 and the fourth housing 114 via the exhaust filter portion 160.

According to an embodiment of the disclosure, the docking station 3 may include the supporter 200.

The supporter 200 may be coupled to the housing 111, 112, 113, and 114 of the body 100. More specifically, the supporter 200 may be coupled to the third housing 113 and the fourth housing 114. The supporter 200 may be coupled to a lower portion of the body 100. The supporter 200 may be coupled to the body 100 to form the accommodating space 218 in which the suction nozzle 13 of the cleaner 2 is accommodated.

The supporter 200 may be rotatable with respect to a floor. According to an embodiment of the disclosure, the supporter 200 may include a fixing portion fixed to the floor, and a rotating portion that is rotatable with respect to the fixing portion. The housing 111, 112, 113, and 114 may be coupled to the rotating portion. Because the rotating portion rotates with respect to the fixing portion, the housing 111, 112, 113, and 113 coupled to the rotating portion may also rotate with respect to the fixing portion. Accordingly, the housing 111, 112, 113, and 114 may rotate with respect to the floor.

Figure 4:
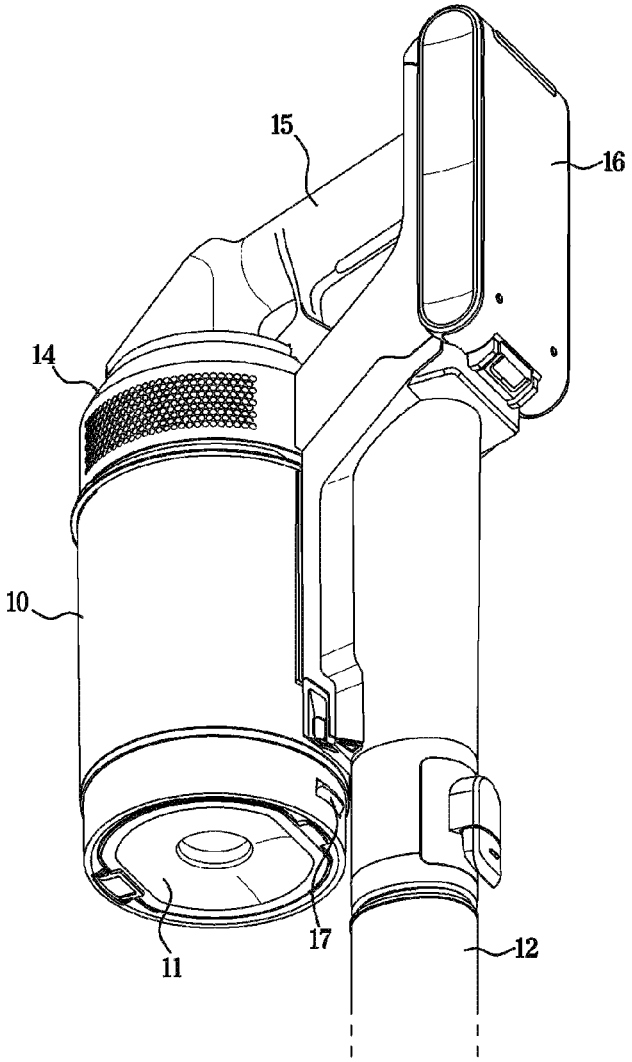
FIG. 4 illustrates an enlarged view of a portion of a cleaner in a cleaning device according to an embodiment of the disclosure.

FIG. 4 illustrates an enlarged view of a portion of a cleaner in a cleaning device according to an embodiment of the disclosure.

Referring to FIG. 4, the cleaner 2 may include a button 17 configured to open and close a dust container cover 11. According to pressing of the button 17, the dust container cover 11 may rotate downward to open. Details about this will be described below.

Figure 5:
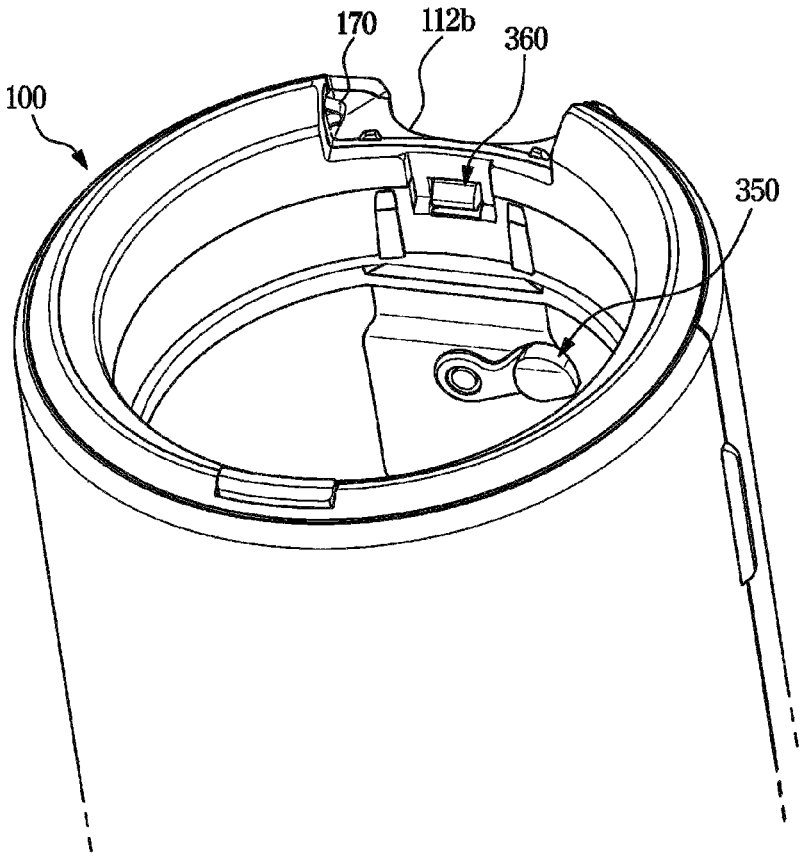
FIG. 5 illustrates an enlarged view of a portion of a docking station in a cleaning device according to an embodiment of the disclosure.

FIG. 5 illustrates an enlarged view of a portion of a docking station in a cleaning device according to an embodiment of the disclosure.

Referring to FIG. 5, the body 100 of the docking station 3 may include a push lever 360 and a closing guide 350. The push lever 360 may press the button 17 by rotating. The closing guide 350 may close the dust container cover 11 by rotating. Details about this will be described below.

Figure 6:
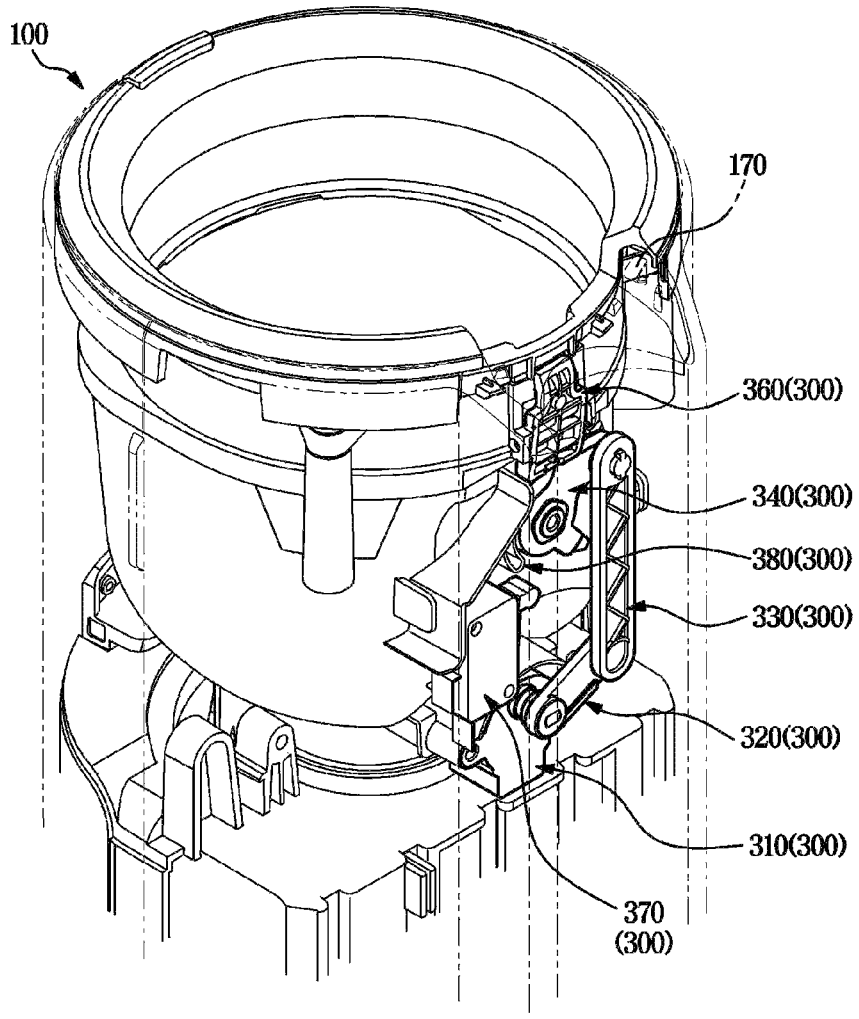
FIG. 6 illustrates a cover opening and closing device in a cleaning device according to an embodiment of the disclosure.

FIG. 6 illustrates a cover opening and closing device in a cleaning device according to an embodiment of the disclosure.

Referring to FIG. 6, the docking station 3 of the cleaning device 1 according to an embodiment of the disclosure may include a cover opening and closing device 300 for automatically opening and closing the dust container cover 11. The cover opening and closing device 300 may be provided in the body 100.

The cover opening and closing device 300 may include a driving motor 310 for providing a driving force, a first guide 320 that rotates by receiving a driving force of the driving motor 310, a second guide 330 that moves up and down by a rotation of the first guide 320, a rotating guide 340 that rotates by a movement of the second guide 330, the closing guide 350 (see FIG. 7) that rotates together with the rotating guide 340, the push lever 360 that presses the button 17 by rotating by the rotating guide 340, a switch 370 that limits a rotation range of the rotating guide 340 and sets a reference point, and a stopper 380 that physically limits the rotation range of the rotating guide 340. Detailed structures of the individual components will be described below.

Figure 7:
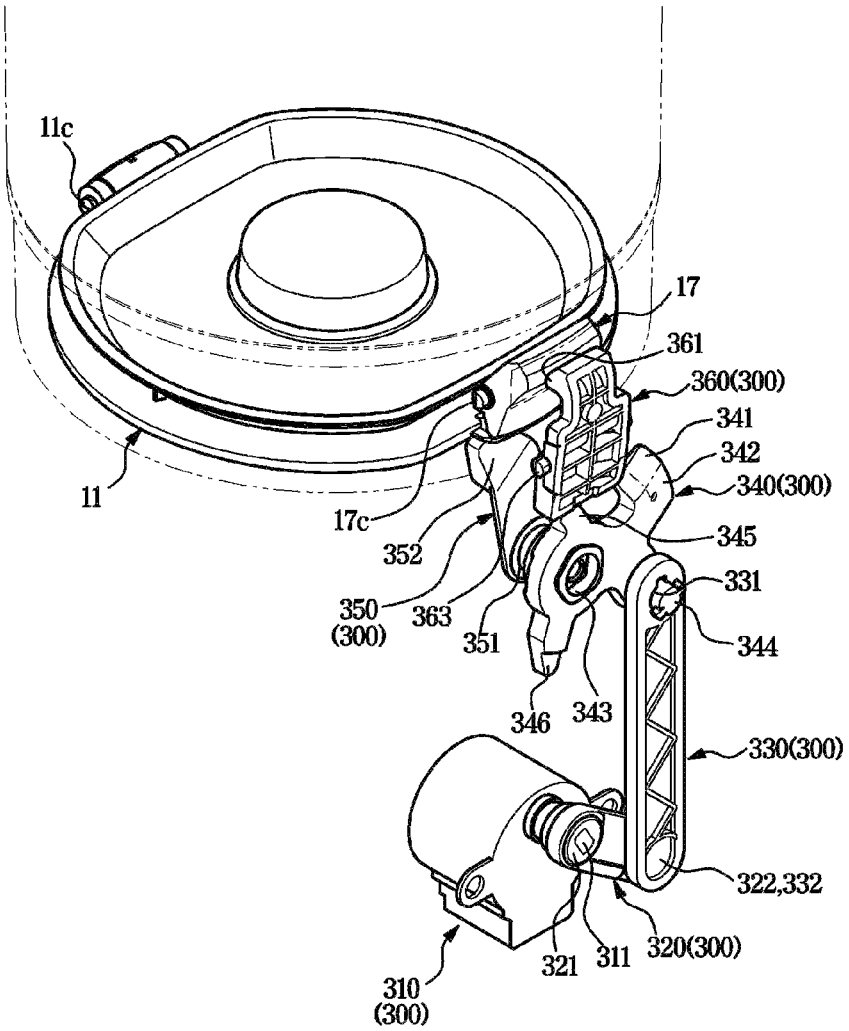
FIG. 7 illustrates a perspective view showing a cover opening and closing device in a state in which a dust container cover of a cleaner is closed, in a cleaning device according to an embodiment of the disclosure.

FIG. 7 illustrates a perspective view showing a cover opening and closing device in a state in which a dust container cover of a cleaner is closed, in a cleaning device according to an embodiment of the disclosure.

Referring to FIG. 7, the cover opening and closing device 300 may include the driving motor 310 that provides a driving force and includes a driving shaft 311 rotating by the driving force, the first guide 320 that rotates together with the driving shaft 311, and the second guide 330 that performs a translational movement in the up-down direction by a rotation of the first guide 320.

The first guide 320 may include one end 321 coupled to the driving shaft 311 and rotating together with the driving shaft 311, and another end 322 coupled to one end of the second guide 330.

The second guide 330 may include one end 332 coupled to the other end 322 of the first guide 320, and a protrusion inserting hole 331 in which a rotating protrusion 344 of the rotating guide 340 is inserted. The protrusion inserting hole 331 may be provided at another end of the second guide 330.

The cover opening and closing device 300 may include the rotating guide 340. The rotating guide 340 may include a first pressing portion 341 that presses the push lever 360, and a second pressing portion 342. The first pressing portion 341 may be connected to the second pressing portion 342, and a thickness of the second pressing portion 342 may be greater than a thickness of the first pressing portion 341.

The rotating guide 340 may include a shaft coupling portion 343 to which a shaft 351 of the closing guide 350 is coupled, the rotating protrusion 344 inserted in the protrusion inserting hole 331 of the second guide 330, and a first limiting protrusion 345 and a second limiting protrusion 346. The shaft 351 which will be described below may be coupled to the shaft coupling portion 343, and the shaft coupling portion 343 may rotate together with the shaft 351. The rotating protrusion 344 may have a shape corresponding to a shape of the protrusion inserting hole 331 to be inserted in the protrusion inserting hole 331. The rotating protrusion 344 may be rotatable relatively with respect to the protrusion inserting hole 331 after being inserted in the protrusion inserting hole 331.

The rotating guide 340 may include the first limiting protrusion 345 that limits a rotation range in first direction of the rotating guide 340, and the second limiting protrusion 346 that limits a rotation range in second direction of the rotating guide 340, wherein the second direction may be opposite to the first direction.

The closing guide 350 may include the shaft 351 coupled to the shaft coupling portion 343 of the rotating guide 340 to rotate together with the rotating guide 340. The closing guide 350 may include a closing protrusion 352 that closes the dust container cover 11 by rotating.

The closing guide 350 may be positioned inside the duct portion 120. Other components of the cover opening and closing device 300 except for the closing guide 350 may be positioned outside the duct portion 120. The closing guide 350 may press the dust container cover 111 by rotating inside the duct portion 120 to close the dust container cover 11.

According to an embodiment of the disclosure, the cover opening and closing device 300 may include the shaft 351 of the closing guide 350, as a component penetrating the duct portion 120. For example, the cover opening and closing device 300 may include no component penetrating the duct portion 120, except for the shaft 351 of the closing guide 350. Because an outer diameter of the shaft 351 of the closing guide 250 is substantially equal to an inner diameter of a hole (not shown) penetrating the duct portion 120, the duct portion 120 may be sealed from inside and outside. However, the outer diameter of the shaft 351 of the closing guide 350 may need to be smaller than the inner diameter of the hole penetrating the duct portion 120 such that the shaft 351 is rotatable inside the hole.

Referring to FIG. 7, the dust container cover 11 may be rotatable with respect to a cover rotating shaft 11*c*. In addition, the button 17 may be rotatable with respect to a button rotating shaft 17*c*.

Figure 8:
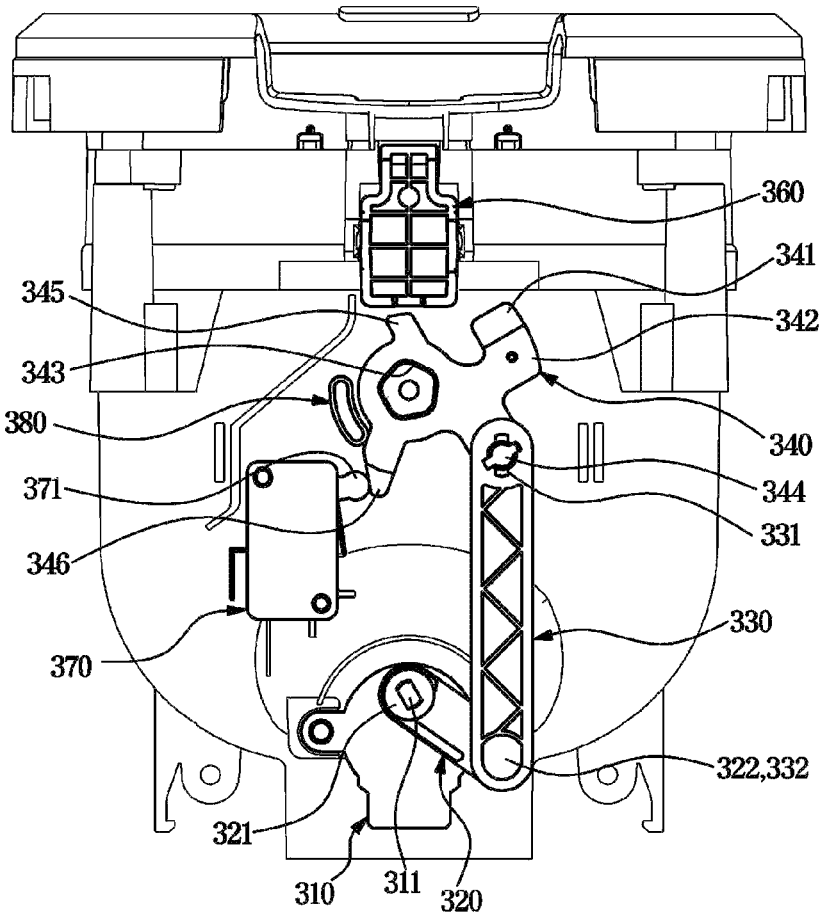
FIG. 8 illustrates a front view of a cover opening and closing device in a state in which a dust container cover of a cleaner is closed, in a cleaning device according to an embodiment of the disclosure.
Figure 9:
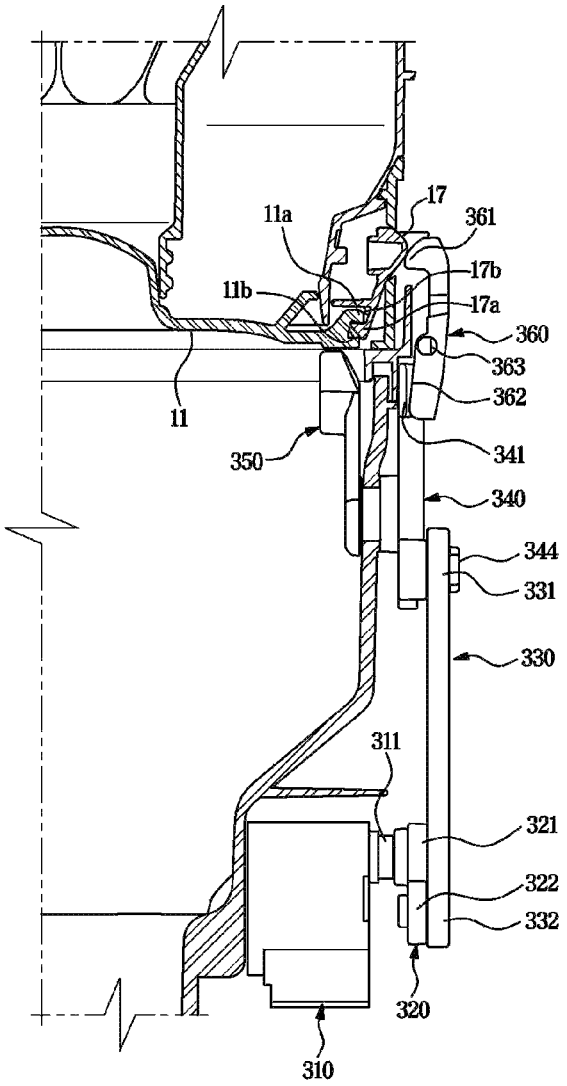
FIG. 9 illustrates a side cross-sectional view of FIG. 8 according to an embodiment of the disclosure.

FIG. 8 illustrates a front view of a cover opening and closing device in a state in which a dust container cover of a cleaner is closed, in a cleaning device according to an embodiment of the disclosure. FIG. 9 illustrates a side cross-sectional view of FIG. 8 according to an embodiment of the disclosure.

Hereinafter, an operation of the cover opening and closing device upon closing of the dust container cover will be described with reference to FIGS. 8 and 9.

Referring to FIG. 8, upon closing of the dust container cover 11, the driving shaft 311 may be in a state in which the driving shaft 311 has rotated in the first direction. According to an embodiment of the disclosure, the first direction may be a clockwise direction in FIG. 8.

According to a rotation in first direction of the driving shaft 311, the first guide 320 may rotate in the first direction. More specifically, the first guide 320 may rotate in the first direction with respect to the one end 321 of the first guide 320, as a center of rotation.

According to the rotation in first direction of the first guide 320 together with the driving shaft 311, the second guide 330 may move downward. The second guide 330 may move downward in a state in which the one end 332 and the other end at which the protrusion inserting hole 331 are positioned vertically. The one end 332 of the second guide 330 may be coupled to the other end 322 of the first guide 320 in such a way to be rotatable relatively with respect to the other end 322 of the first guide 320. In addition, the other end of the second guide 330 may be coupled to the rotating protrusion 344 of the rotating guide 340 in such a way as to be rotatable relatively with respect to the rotating protrusion 344 of the rotating guide 340. As described above, the reason may be because the rotating protrusion 344 inserted in the protrusion inserting hole 331 provided in the other end of the second guide 330 is rotatable relatively with respect to the second guide 330.

The rotating guide 340 may move in the first direction according to the downward movement of the second guide 330. The rotating guide 340 may rotate in the same direction as the first guide 320. For example, according to a rotation in first direction of the first guide 320, the rotating guide 340 may rotate in the first direction. The rotating guide 340 may rotate with respect to the shaft coupling portion 343 as a center of rotation. According to a rotation in first direction of the rotating guide 340, the second limiting protrusion 346 may press a switching protrusion 371 of the switch 370. In addition, the second limiting protrusion 346 may contact another end of the stopper 380.

According to an embodiment of the disclosure, a rotation range in first direction of the rotating guide 340 may be limited in two ways. According to pressing of the switching protrusion 371 by the second limiting protrusion 346 of the rotating guide 340, the driving motor 310 may stop. In addition, according to pressing of the switching protrusion 371 by the second limiting protrusion 346, a reference position of the driving shaft 311 may be reset. According to a rotation in first direction of the rotating guide 340, the second limiting protrusion 346 may contact the other end of the stopper 380. According to the contact of the second limiting protrusion 346 to the other end of the stopper 380, the rotating guide 340 may no longer rotate in the first direction by an interference of the second limiting protrusion 346 with the stopper 380. For example, in a case in which the driving motor 310 operates even though the switching protrusion 371 is pressed, the second limiting protrusion 346 may contact the stopper 380 to thereby stop a rotation in first direction of the rotating guide 340.

Referring to FIG. 9, according to a rotation in first direction of the rotating guide 340 by a driving force of the driving motor 310, the closing guide 350 may rotate in the first direction. According to the rotation in first direction of the closing guide 350, the closing guide 350 may press the dust container cover 11 upward to close the dust container cover 11. The dust container cover 11 may receive an elastic force from an elastic member 11*d* (see FIG. 3) in a direction in which the dust container cover 11 is closed, which is not shown in the drawing. For example, the dust container cover 11 may be elastically biased in the direction in which the dust container cover 11 is closed. Although the dust container cover 11 rotates in the direction in which the dust container cover 11 is closed by an elastic force of the elastic member 11*d*, the dust container cover 11 may be not closed only by the elastic force of the elastic member 11*d*. The closing guide 350 may rotate in the first direction to press the dust container cover 11 upward, thereby closing the dust container cover 11. More particularly, the closing protrusion 352 of the closing guide 350 may press the dust container cover 11 upward.

The dust container cover 11 may include a cover protrusion 11*a* and a cover groove 11*b*. The button 17 may include a button protrusion 17*a* and a button groove 17*b*. The cover protrusion 11*a* of the dust container cover 11 may be inserted in the button groove 17*b*, and the button protrusion 17*a* of the button 17 may be inserted in the cover groove 11*b*, thereby closing the dust container cover 11.

Figure 10:
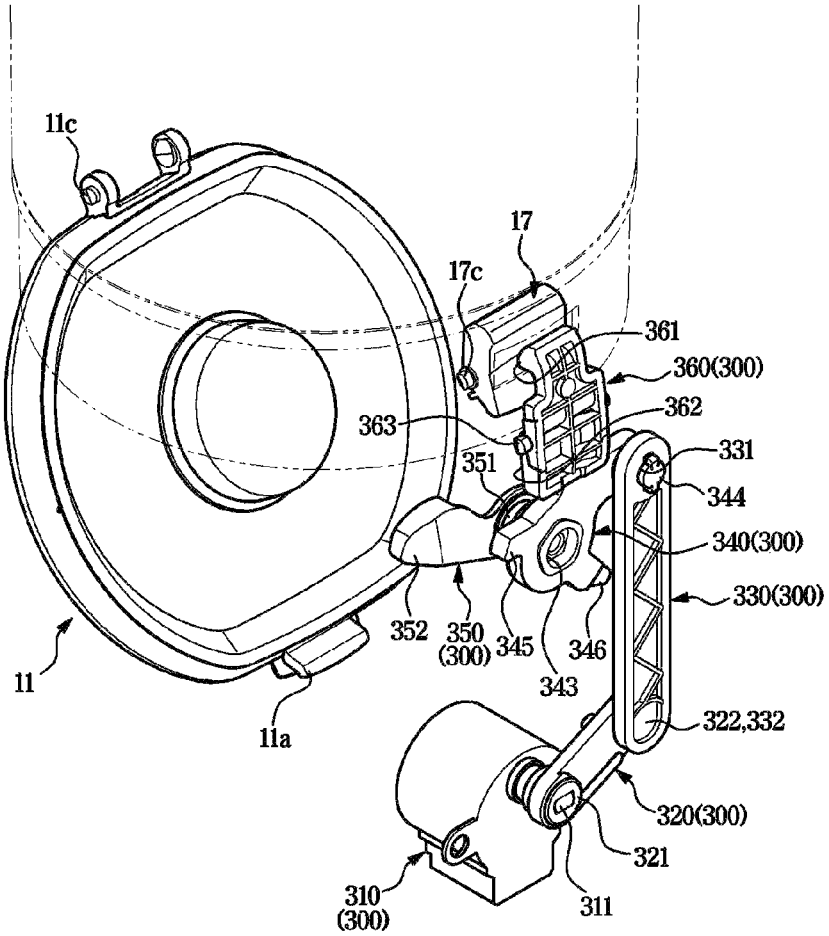
FIG. 10 illustrates a perspective view showing a cover opening and closing device in a state in which a dust container cover of a cleaner opens, in a cleaning device according to an embodiment of the disclosure.

FIG. 10 illustrates a perspective view showing a cover opening and closing device in a state in which a dust container cover of a cleaner opens, in a cleaning device according to an embodiment of the disclosure.

Referring to FIG. 10, the driving motor 310 may rotate the driving shaft 311 in the second direction that is opposite to the first direction to open the dust container cover 11.

According to an embodiment of the disclosure, the second direction may be a counterclockwise direction.

According to the rotation in second direction of the driving shaft 311, the first guide 320 may rotate in the second direction together with the driving shaft 311. The second guide 330 may move upward according to the rotation in second direction of the first guide 320. According to the upward movement of the second guide 330, the rotating guide 340 may rotate in the second direction. The rotating guide 340 may rotate in the same direction as the first guide 320. For example, the rotating guide 340 may rotate in the second direction according to a rotation in second direction of the first guide 320. The closing guide 350 may rotate in the second direction together with the second guide 330.

According to the rotation in second direction of the rotating guide 340, the rotating guide 340 may press the push lever 360. The push lever 360 may rotate with respect to a lever rotating shaft 363 by the rotating guide 340. According to the rotation of the push lever 360 with respect to the lever rotating shaft 363, a push protrusion 361 of the push lever 360 may press the button 17. According to the pressing of the button 17, the dust container cover 11 may open. As described above, because the dust container cover 11 receives an elastic force in the direction in which the dust container cover 11 is closed, a suction force of the suction portion 150 may need to be provided to open the dust container cover 11.

Figure 11:
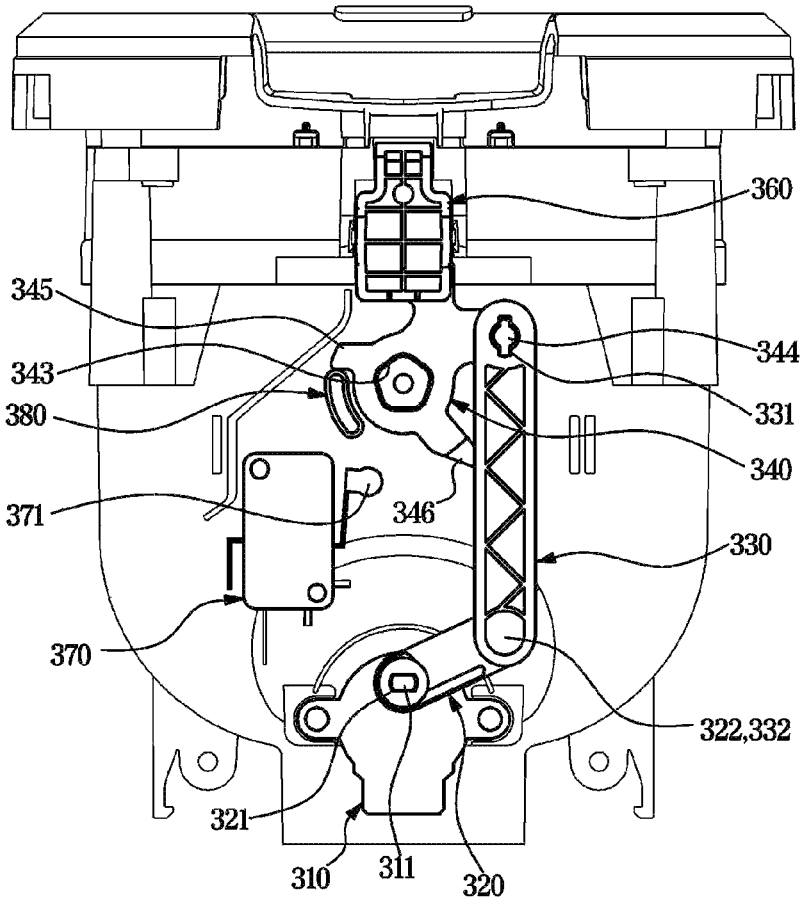
FIG. 11 illustrates a front view of a cover opening and closing device in a state in which a dust container cover of a cleaner opens, in a cleaning device according to an embodiment of the disclosure.
Figure 12:
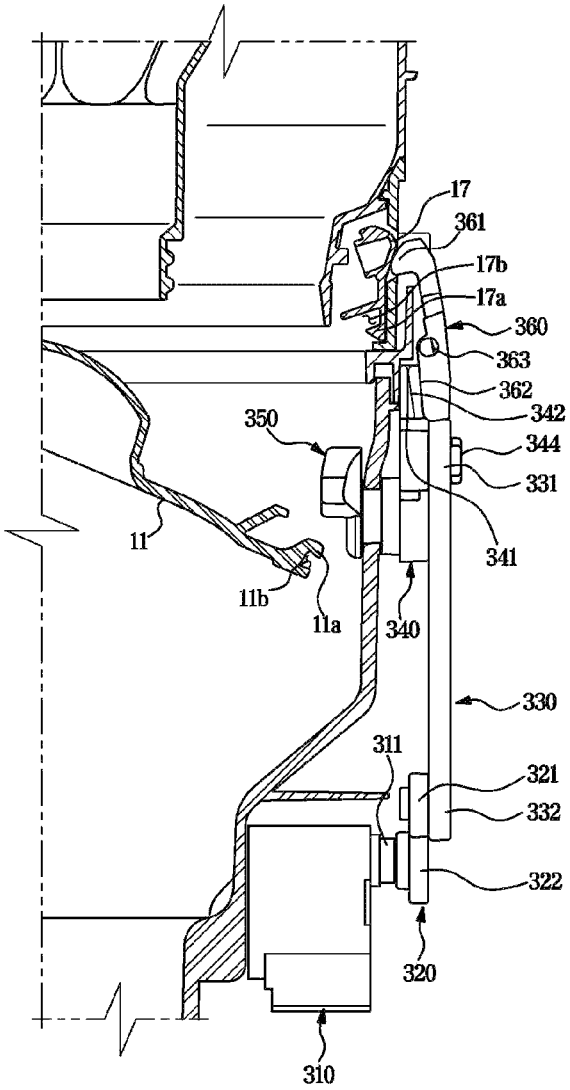
FIG. 12 illustrates a side cross-sectional view of FIG. 11 according to an embodiment of the disclosure.

FIG. 11 illustrates a front view of a cover opening and closing device in a state in which a dust container cover of a cleaner opens, in a cleaning device according to an embodiment of the disclosure. FIG. 12 illustrates a side cross-sectional view of FIG. 11 according to an embodiment of the disclosure.

Referring to FIG. 11, according to a rotation in second direction of the driving shaft 311 by a driving force of the driving motor 310, the first guide 320 may rotate in the second direction, and the second guide 330 may move upward. According to the upward movement of the second guide 330, the rotating guide 340 may rotate in the second direction.

According to an embodiment of the disclosure, the push lever 360 may rotate with respect to the lever rotating shaft 363 according to the rotation in second direction of the rotating guide 340. The reason may be because the rotating guide 340 rotated in the second direction presses the push lever 360 to rotate the push lever 360.

According to the rotation in second direction of the rotating guide 340, the first limiting protrusion 345 of the rotating guide 340 may contact one end of the stopper 380. According to the contact of the first limiting protrusion 345 to the one end of the stopper 380, the rotation in second direction of the rotation guide 340 may be limited. For example, according to a physical contact of the first limiting protrusion 345 to the stopper 380, a rotation range in second direction of the rotating guide 340 may be limited. In contrast, the driving motor 310 may rotate the driving shaft 311 by a preset angle in the second direction. For example, the driving motor 310 may have been set in advance to rotate the driving shaft 311 by about 60 degrees in the second direction. According to a rotation of the driving shaft 311 by about 60 degrees in the second direction, the rotating guide 340 may press the push lever 360. According to an embodiment of the disclosure, according to a rotation in first direction of the rotating guide 340, the second limiting protrusion 346 may press the switching protrusion 371 to reset the reference position of the driving shaft 311. Although the driving motor 310 has been set in advance to rotate the driving shaft 311 by the preset angle in the second direction, repeated rotations of the driving shaft 311 in the first direction and the second direction may cause the reference position to be away from an initial setting position. By resetting the reference position whenever the driving shaft 311 rotates in the first direction, the reference position of the driving shaft 311 may be prevented in advance from being away from the initial setting position.

Referring to FIG. 12, according to a rotation in second direction of the rotating guide 340, the second pressing portion 342 of the rotating guide 340 may press a pressed surface 362 of the push lever 360. The rotating guide 340 may include the first pressing portion 341 having a relatively small thickness and the second pressing portion 342 having a relatively great thickness. The first pressing portion 341 may be connected to the second pressing portion 342, and a thickness of the rotating guide 340 may increase from the first pressing portion 341 to the second pressing portion 342. According to the rotation in second direction of the rotating guide 340, the first pressing portion 341 may start contacting the pressed surface 362 and the second pressing portion 342 may press the pressed surface 362. For example, the first pressing portion 341 and the second pressing portion 342 may press the pressed surface 362 gradually.

An extension direction of the driving shaft 311 is assumed to be a third direction. In this case, each of the first guide 320, the second guide 330 and the rotating guide 340 may rotate with respect to a rotating axis that is parallel to the third direction. The push lever 360 may rotate with respect to the lever rotating shaft 363 extending in a fourth direction that intersects with the third direction.

According to pressing of the button 17 by the push protrusion 361 of the push lever 360, the button 17 may rotate with respect to the button rotating shaft 17*c* that is parallel to the fourth direction. According to the rotation of the button 17 with respect to the button rotating shaft 17*c*, the cover protrusion 11*a* of the dust container cover 11 may be withdrawn from the button groove 17*b*, and the button protrusion 17*a* may be withdrawn from the cover groove 11*b*. Because the cover protrusion 11*a* is withdrawn from the button groove 17*b* and the button protrusion 17*a* is withdrawn from the cover groove 11*b*, the dust container cover 11 may open. The button rotating shaft 17*c* may be parallel to the lever rotating shaft 363. For example, the button rotating shaft 17*c* may extend in a direction that is parallel to the fourth direction.

Figure 13:
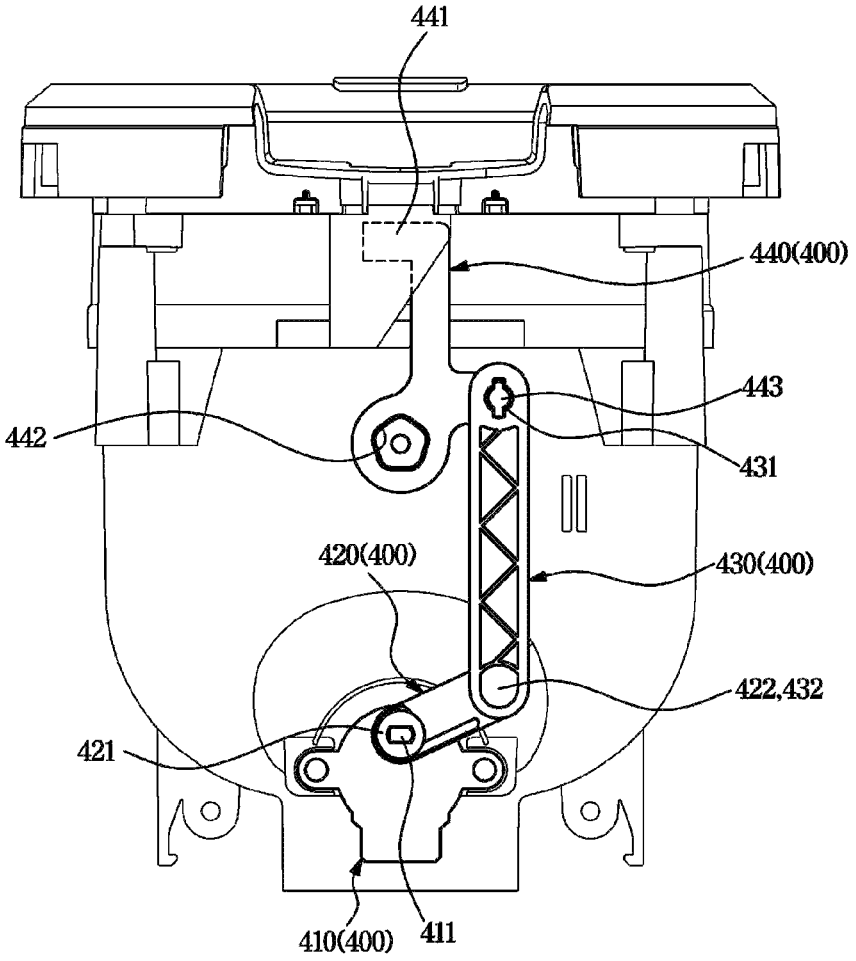
FIG. 13 illustrates a front view of a cover opening and closing device in a state in which a dust container cover of a cleaner is closed, in a cleaning device according to an embodiment of the disclosure.
Figure 14:
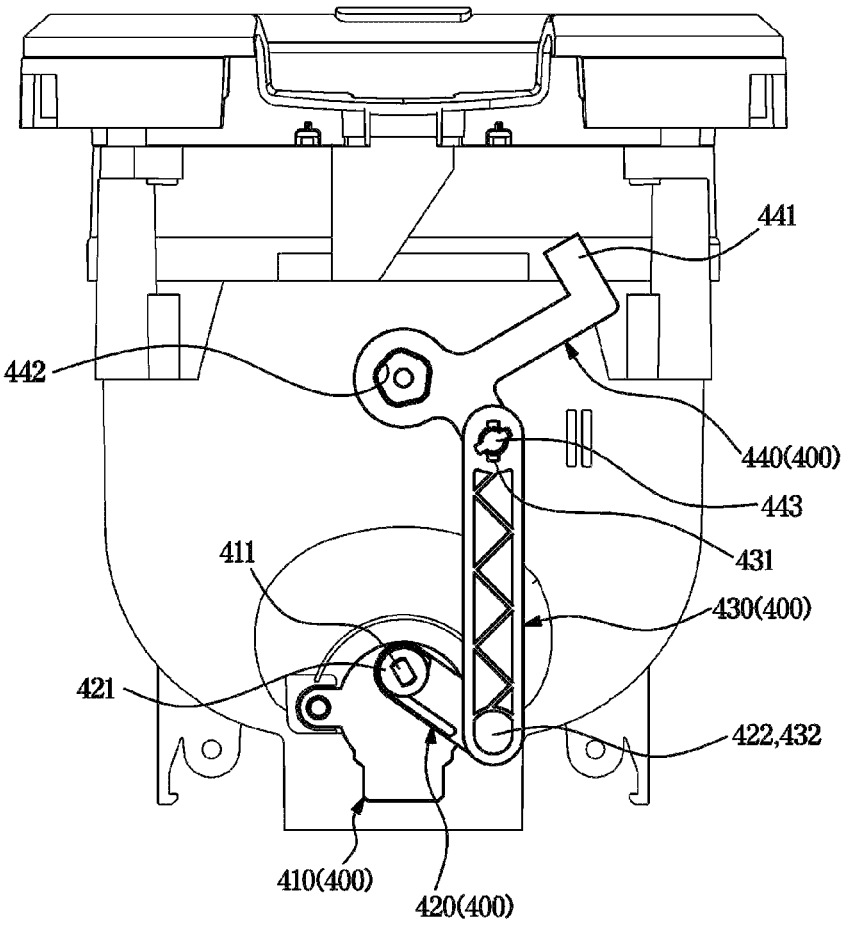
FIG. 14 illustrates a front view of a cover opening and closing device in a state in which a dust container cover of a cleaner opens, in a cleaning device according to an embodiment of the disclosure.

FIG. 13 illustrates a front view of a cover opening and closing device in a state in which a dust container cover of a cleaner is closed, in a cleaning device according to an embodiment of the disclosure. FIG. 14 illustrates a front view of a cover opening and closing device in a state in which a dust container cover of a cleaner opens, in a cleaning device according to an embodiment of the disclosure.

Hereinafter, an embodiment of the disclosure will be described with reference to FIGS. 13 and 14. Descriptions about content overlapping with that described above will be omitted for convenience.

According to an embodiment of the disclosure, a cover opening and closing device 400 may include a driving motor 410 for rotating a driving shaft 411, a first guide 420, a second guide 430, and a rotating guide 440. In addition, the cover opening and closing device 400 may include a closing guide (not shown), which is not shown in the drawings. The first guide 420, the second guide 430, and the closing guide may have the same structures as the first guide 320, the second guide 330, and the closing guide 350 described above.

According to an embodiment of the disclosure, the cover opening and closing device 400 may include none of a push lever, a switch, a stopper, a first limiting protrusion, and a second limiting protrusion. For example, by simplifying a configuration of the cover opening and closing device 400, productivity may be improved.

The first guide 420 may include one end 421 coupled to the driving shaft 411 and rotating together with the driving shaft 411, and another end 422 coupled to one end of the second guide 430.

The second guide 430 may include one end 432 coupled to the other end 422 of the first guide 420, and a protrusion inserting hole 431 in which a rotating protrusion 443 of the rotating guide 440 is inserted. The protrusion inserting hole 431 may be provided at another end of the second guide 430.

The rotating guide 440 may include a shaft coupling portion 442, and the rotating protrusion 443 inserted in the protrusion inserting hole 431 of the second guide 430. The rotating protrusion 443 may have a shape corresponding to a shape of the protrusion inserting hole 431 to be inserted in the protrusion inserting hole 431. The rotating protrusion 443 may be rotatable relatively with respect to the protrusion inserting hole 431 after being inserted in the protrusion inserting hole 431.

The cover opening and closing device 400 may rotate the rotating guide 440 in a first direction or a second direction by operating the driving motor 410. According to a rotation in second direction of the rotating guide 440, a pressing protrusion 441 of the rotating guide 440 may press the button 17. According to the pressing of the button 17, the dust container cover 11 may open.

According to a rotation in first direction of the rotating guide 440, the closing guide (not shown) may press the dust container cover 11 upward and accordingly, the dust container cover 11 may be closed.

According to an embodiment of the disclosure, although there is none of the switch, the stopper, the first limiting protrusion and the second limiting protrusion, the driving motor 410 may rotate in the first direction or the second direction within a preset angle range to open and close the dust container cover 11. For example, the driving motor 410 may have been set in advance to rotate the driving shaft 411 from a reference position by 60 degrees in the first direction. In addition, the driving motor 410 may have been set in advance to rotate the driving shaft 411 rotated by 60 degrees in the first direction from the reference position by 60 degrees in the second direction. Through the settings, a movement range of the driving shaft may be limited in a control way without using the switch, the stopper, or the first limiting protrusion and the second limiting protrusion.

While the disclosure has been shown and described with reference to various embodiments thereof, it will be understood by those skilled in the art that various changes in from and details may be made therein without departing from the spirit and scope of the disclosure as defined by the appended claims and their equivalents.

What is claimed is:

1. A cleaning device comprising:

a cleaner comprising a dust container in which foreign substances are collected, a dust container cover rotatably coupled to the dust container and configured to open and close the dust container, and a button configured to open the dust container cover;

a docking station to which the cleaner is coupled, the docking station configured to charge the cleaner coupled thereto; and a cover opening and closing device configured to open the dust container cover by pressing the button and close the dust container cover by pressing the dust container cover, wherein the cover opening and closing device comprises:

a driving motor configured to provide a driving force; and a guide comprising a rotating guide and a closing guide, the rotating guide being configured to press the button when receiving the driving force from the driving motor, the closing guide including a closing protrusion configured to close the dust container cover by rotating when receiving the driving force from the driving motor, the rotating guide and the closing guide being coupled to each other.

2. The cleaning device of claim 1, wherein the driving motor comprises a driving shaft configured to rotate in a first direction or a second direction that is-opposite to the first direction by the driving force.

3. The cleaning device of claim 2, wherein the guide further comprises:

a first guide configured to rotate in the first direction or the second direction together with the driving shaft; and a second guide configured to perform a translational movement according to a rotation of the first guide.

4. The cleaning device of claim 3, wherein the rotating guide is configured to rotate in the first direction or the second direction according to a translational movement of the second guide, and wherein the rotating guide presses the button by rotating in the second direction.

5. The cleaning device of claim 4, wherein the cover opening and closing device further comprises:

a push lever configured to press the button by rotating in the first direction and a third direction different from the second direction, according to a rotation in the second direction of the rotating guide.

6. The cleaning device of claim 5, wherein a rotating shaft of the push lever intersects with a rotating shaft of the rotating guide.

7. The cleaning device of claim 5, wherein the closing guide is configured to press the dust container cover by rotating in the first direction together with the rotating guide, according to a rotation in the first direction of the rotating guide.

8. The cleaning device of claim 7, wherein the docking station further comprises a duct configured to guide foreign substances collected in the dust container into a dust bag, and wherein the closing guide is positioned inside the duct.

9. The cleaning device of claim 8, wherein the driving motor, the first guide, the second guide, the rotating guide, and the push lever are positioned outside the duct.

10. The cleaning device of claim 4, wherein the rotating guide further comprises:

a first limiting protrusion configured to limit a rotation range of the rotating guide in the first direction; and a second limiting protrusion configured to limit a rotation range of the rotating guide in the second direction.

11. The cleaning device of claim 10, wherein the docking station further comprises a stopper configured to limit movement ranges of the first limiting protrusion and the second limiting protrusion, wherein a first end of the stopper contacts the first limiting protrusion according to a rotation in the first direction of the rotating guide, and wherein a second end of the stopper contacts the second limiting protrusion according to a rotation in the second direction of the rotating guide.

12. The cleaning device of claim 10, wherein the cover opening and closing device further comprises:

a switch configured to be pressed by the first limiting protrusion according to a rotation in the first direction of the rotating guide, and wherein, according to a pressing of the switch, the driving motor stops and a reference position of the driving shaft is reset.

13. The cleaning device of claim 1, wherein the cleaner further comprises an elastic member configured to elastically bias the dust container cover such that the dust container cover rotates in a direction of being closed.

* * * * *